US009667004B1

(12) United States Patent
Wu

(10) Patent No.: US 9,667,004 B1
(45) Date of Patent: May 30, 2017

(54) PATCH PANEL

(71) Applicant: HSING CHAU INDUSTRIAL CO., LTD., Taipei (TW)

(72) Inventor: Kei-Wei Wu, Taipei (TW)

(73) Assignee: HSING CHAU INDUSTRIAL CO., LTD., Taipei (TW)

( * ) Notice: Subject to any disclaimer, the term of this patent is extended or adjusted under 35 U.S.C. 154(b) by 0 days.

(21) Appl. No.: 15/210,153

(22) Filed: Jul. 14, 2016

(51) Int. Cl.

| | |
|---|---|
| ***H01R 13/00*** | (2006.01) |
| ***H01R 13/518*** | (2006.01) |
| ***H01R 25/00*** | (2006.01) |
| ***H01R 24/64*** | (2011.01) |
| ***H01R 24/76*** | (2011.01) |
| *H01R 107/00* | (2006.01) |

(52) U.S. Cl.
CPC ..... *H01R 25/006* (2013.01); *H01R 24/64* (2013.01); *H01R 24/76* (2013.01); *H01R 2107/00* (2013.01)

(58) Field of Classification Search
CPC ..... H01R 25/006; H01R 24/64; H01R 24/76; H01R 2107/00; H01R 13/518
See application file for complete search history.

(56) References Cited

U.S. PATENT DOCUMENTS 5,735,714 A * 4/1998 Orlando ..... H01R 13/6658 439/535
7,094,095 B1 * 8/2006 Caveney ..... G02B 6/3897 385/134
7,311,550 B2 * 12/2007 Hammond, Jr. ... H01R 13/6461 439/540.1
8,992,260 B2 * 3/2015 Coffey ..... H01R 13/641 439/620.22
2008/0090454 A1 * 4/2008 Hoath ..... H04Q 1/136 439/540.1
2008/0096438 A1 * 4/2008 Clark ..... H01R 13/518 439/713
2009/0047800 A1 * 2/2009 Tabet ..... H01R 13/518 439/32
2013/0344733 A1 * 12/2013 Mateo ..... H04Q 1/13 439/540.1
2014/0220794 A1 * 8/2014 Taylor ..... H04Q 1/13 439/55

* cited by examiner

*Primary Examiner* — Briggitte R Hammond
(74) *Attorney, Agent, or Firm* — WPAT, P.C., Intellectual Property Attorneys; Anthony King

(57) ABSTRACT

A patch panel includes sockets and mounting frames. The mounting frames each have a plugging side and a terminal side. Plugging planes of the sockets are exposed from a vias on mounting surfaces of the mounting frames. The sockets are disposed on each mounting frame and arranged in two parallel rows, including an upper row and a lower row. The plugging planes of the sockets of one of the upper and lower rows retract from the mounting surface toward the terminal side by a predetermined distance; hence, the retracted plugging planes of the retracted row do not lie on the same plane as the non-retracted plugging planes of the non-retracted row. The patch panel features larger spacing between a disturbing channel and a disturbed channel and lesser significant alien crosstalk, thereby offsetting alien crosstalk without violating the EIA-310 standard.

9 Claims, 10 Drawing Sheets

PATCH PANEL

FIELD OF THE INVENTION

The present invention relates to patch panels and, more particularly, to a patch panel conducive to reduction of alien crosstalk.

BACKGROUND OF THE INVENTION

Recent explosive growth of data transmission speed results from rapid advancements of network-based transmission technology. According to existing Augmented Category 6 standard (such as TIA-568-C.2 and ISO-11801 ed.2) of an 10 GBASE-T protocol of IEEE 802.3, with an RJ-45 connectors serving as standard interfaces for network connectors, the data transmission speed is 1000 times (10 Gbs/sec) higher than the initial speed (10 Mbs/sec), whereas the operating frequency increases from 16 MHz to 500 MHz. Given the ever-increasing transmission speeds and operating frequencies of broadband networks, it is important to reduce crosstalk. In this regard, crosstalk falls into two categories, namely internal crosstalk and alien crosstalk. The internal crosstalk occurs whenever unwanted capacitive coupling or inductive coupling happens between internal wirings of a single network channel. The alien crosstalk occurs whenever unwanted capacitive coupling or inductive coupling happens as a result of mutual interference of multiple network channels. In general, the routing of the internal circuitry of a single network channel and compensation mechanism can solve the aforesaid problems with internal crosstalk, whereas the aforesaid problems with alien crosstalk can be solved by widening the distance between multiple network channels.

Referring to FIG. 1, there is shown a perspective view of a plurality of first conventional patch panels which stack one above the other. In typical horizontal cablings, horizontal cables are terminated into multiple patch panels that make future "move", "add" and "change" possible. The patch panels are proximately mounted on equipment racks. The prevailing 24-port patch panel usually features shoulder by shoulder mechanism with port-to-port spacing no more than 18.50 mm due to EIA-310 standard limitation. Standard specifies 450 mm as usable dimension, so a standard compliant patch panel must have 18.50 mm×24 as maximum. Referring to FIG. 2, there is shown a graph of measurement of alien crosstalk of the first conventional patch panel shown in FIG. 1. According to inventor's experiments, even with the maximum spacing 18.50 mm, the severity of alien crosstalk degrades the SNR to an intolerable level.

There have always been new designs that intended to reduce alien crosstalk that is induced to the disturbed network ports. Referring to FIG. 3, there is shown a perspective view of a plurality of second conventional patch panels which stack one above the other. The most-common-seen design typically features port-to-port staggered design. The practical way to do this is enlarge the spacing between the disturbing and the disturbed network ports in a one-axis movement. Referring to FIG. 3, the spacing between the centers of corner network ports and disturbed network port is each denoted with a1 & b1. The spacing between the centers of upper & lower network ports and disturbed network port is each denoted with a2 & b2. The spacing between the centers of side network ports and disturbed network port is each denoted with a3 & b3. The greatest alien crosstalk occurs between the network ports spaced apart by distances a1 & b1. Moderate alien crosstalk occurs between the network ports spaced apart by distances a2 & b2. The least and thus negligible alien crosstalk occurs between the network ports spaced apart by distances a3 & b3 since a3 & b3 has been twice the distance as it is supposed to be.

Referring to FIG. 4, there is shown a graph of measurement of alien crosstalk of the second conventional patch panels shown in FIG. 3. Although alien crosstalk may be considerably reduced therewith, still only a marginal fail can be achieved which is near around 60 dB SNR. But it is still way too insufficient to meet 70 dB SNR that runs 10 Gbps as standard proposed.

SUMMARY OF THE INVENTION

It is an objective of the present invention to neutralize the alien crosstalk generated from neighboring ports.

Another objective of the present invention is to enable patch panels to be positioned at acceptable levels that support high speed, such as 10 Gbps or higher, so that no Ethernet needs to screen or shield the patch panels.

In order to achieve the above and other objectives, the present invention provides a patch panel, comprising a plurality of sockets and a mounting frame, the mounting frame having a plugging side and a terminal side, having a mounting surface on the plugging side, and being mounted with the sockets such that plugging planes of the sockets are exposed from a plurality of vias on the mounting surface of the mounting frame, characterized in that: the sockets are disposed on the mounting frame and arranged in two parallel rows including an upper row and a lower row, wherein the plugging planes of the sockets of one of the upper and lower rows retract toward the terminal side by a predetermined distance such that the plugging planes of the retracted row do not lie on the same plane as the plugging planes of the non-retracted row.

In an embodiment of the present invention, the sockets of the upper and lower rows are spaced apart from each other but do not overlap.

In an embodiment of the present invention, any two adjacent ones of the sockets of the same row are equidistant from each other.

In an embodiment of the present invention, shortest distances between centers of the plugging planes of sockets with non-retracted plugging planes and centers of the plugging planes of adjacent sockets with retracted plugging planes are equal and defined as the first shortest distances, whereas shortest distances between centers of the plugging planes of sockets with retracted plugging planes and centers of the plugging planes of adjacent sockets with non-retracted plugging planes are equal and defined as the second shortest distances.

In an embodiment of the present invention, shortest distances between the sockets and their respective adjacent sockets in the vertical direction are equal, whereas shortest distances between the sockets and their respective adjacent sockets in the horizontal direction are equal.

In an embodiment of the present invention, the predetermined distance is 10 mm, with the sockets being network sockets which comply with RJ-45 communication standard, wherein configuration between the mounting frame and each said socket complies with EIA-310 specification standard.

In order to achieve the above and other objectives, the present invention further provides a patch panel structure, comprising a plurality of sockets and a plurality of mounting frames mounted on an equipment chassis, with the mounting frames being tightly stacked vertically, each having a plugging side and a terminal side, each having a mounting surface on the plugging side, and each being mounted with the sockets such that plugging planes of the sockets are exposed from a plurality of vias on the mounting surfaces of the mounting frames, characterized in that: the sockets are disposed on each said mounting frame and arranged in two parallel rows, including an upper row and a lower row, in one of two ways below: on each mounting frame, the plugging planes of the sockets of the upper row retract from the mounting surface toward the terminal side by a predetermined distance such that the plugging planes of the upper row do not lie on a same plane as the plugging planes of the lower row; and on each mounting frame, the plugging planes of the sockets of the lower row retract from the mounting surface toward the terminal side by a predetermined distance such that the plugging planes of the upper row do not lie on the same plane as the plugging planes of the lower row.

In an embodiment of the present invention, shortest distances between the sockets and their respective adjacent sockets in the vertical direction are equal, whereas shortest distances between the sockets and their respective adjacent sockets in the horizontal direction are equal, wherein the centers of the plugging planes of the sockets with retracted plugging planes and the centers of the plugging planes of the sockets with non-retracted plugging planes are equally separated from the centers of the plugging planes of adjacent sockets on the upper right, from the centers of the plugging planes of adjacent sockets on the upper left, from the centers of the plugging planes of adjacent sockets on the lower right, and from the centers of the plugging planes of adjacent sockets on the lower left such that sockets with retracted plugging planes are subjected to the same interference as sockets with non-retracted plugging planes, respectively.

The patch panel of the present invention features larger spacing between a disturbing channel and a disturbed channel and lesser significant alien crosstalk. Hence, compared with the prior art, the present design features two rows of network ports. One row is surface-mounted to the panel sheet, the other row is retracted from it by a distance of 10 mm Thus, the spacing between the centers of corner network ports and disturbed network port is maximized not only in X/Y axis but also in Z axis. Therefore, the patch panel of present invention is feasible to offset alien crosstalk without violating the EIA-310 standard. Moreover, regardless of whether the odd ports or even ports are regarded as disturbed network ports, the immunity of alien crosstalk is conceptually the same.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION OF THE PREFERRED EMBODIMENTS

A patch panel is usually mounted on an equipment chassis. A mounting frame in the patch panel is fixed to the equipment chassis, and thus a plurality of sockets mounted on the mounting frame can be fixed in place inside the equipment. The sockets are positioned on the mounting frame and thus disposed at predetermined positions, respectively, to connect with external circuits from, for example, a network equipment machine, thereby effectuating electrical coupling.

Figure 1:
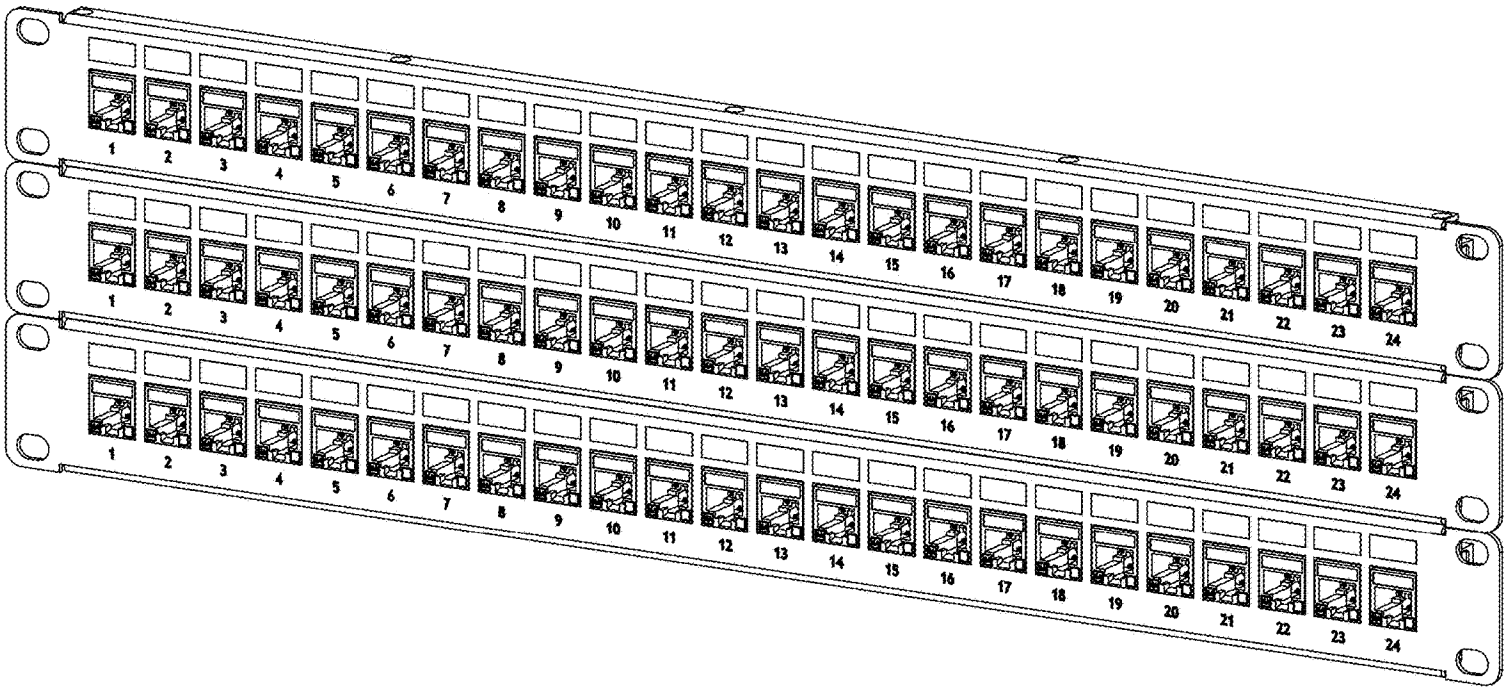
FIG. 1 (PRIOR ART)
FIG. 1 (PRIOR ART) is a perspective view of a plurality of first conventional patch panels which stack one above the other.
Figure 2:
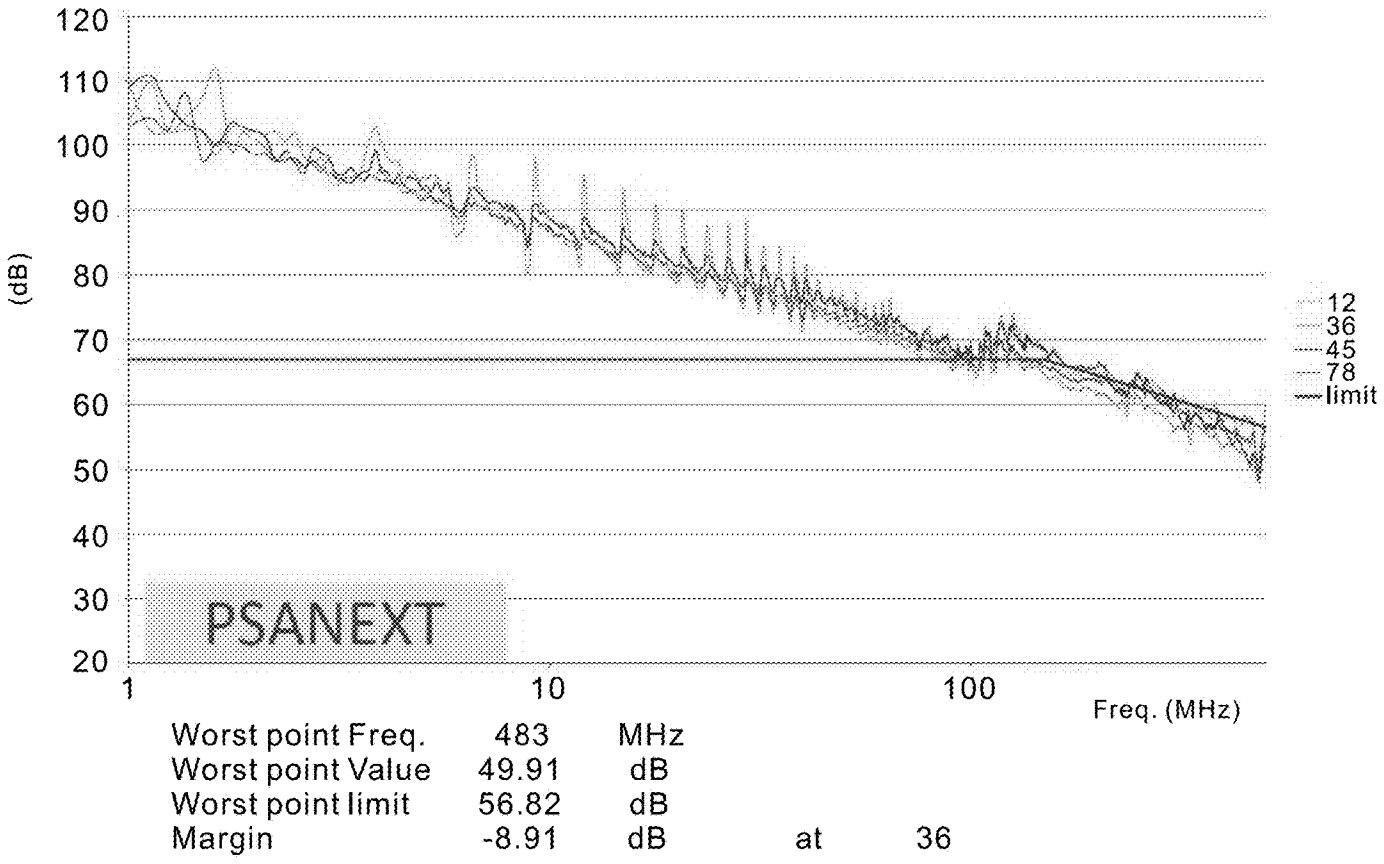
FIG. 2 (PRIOR ART)
FIG. 2 (PRIOR ART) is a graph of measurement of alien crosstalk of the first conventional patch panel shown in FIG. 1.
Figure 3:
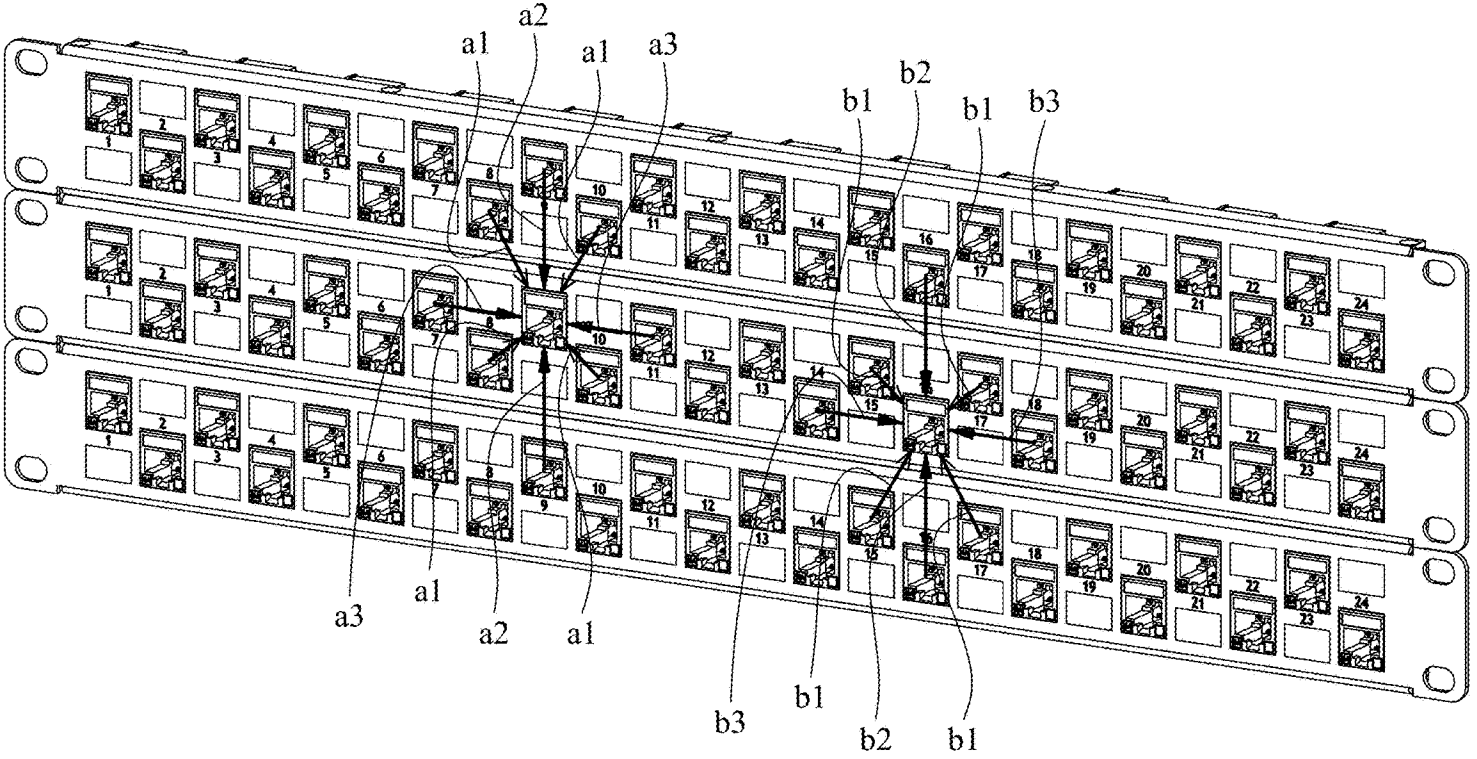
FIG. 3 (PRIOR ART)
FIG. 3 (PRIOR ART) is a perspective view of a plurality of second conventional patch panels which stack one above the other.
Figure 4:
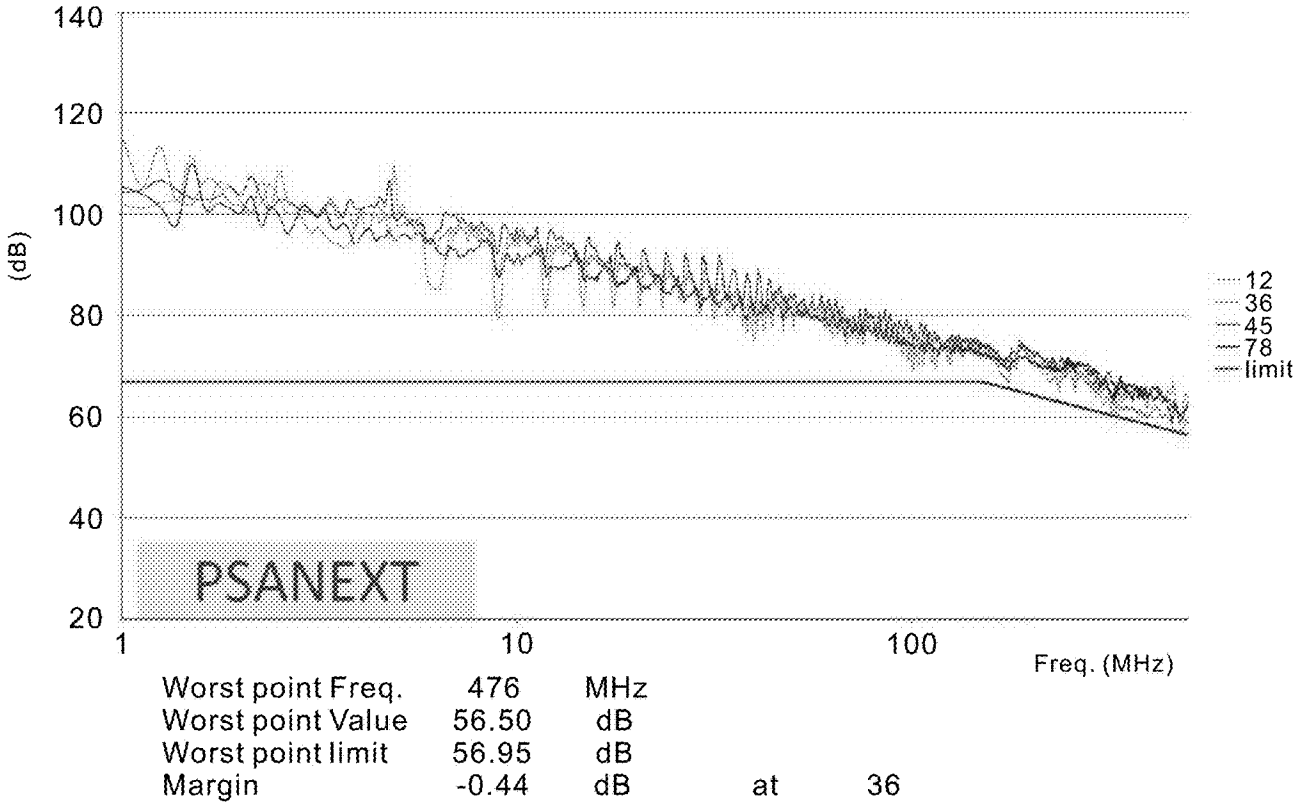
FIG. 4 (PRIOR ART)
FIG. 4 (PRIOR ART) is a graph of measurement of alien crosstalk of the second conventional patch panels shown in FIG. 3.
Figure 5A:
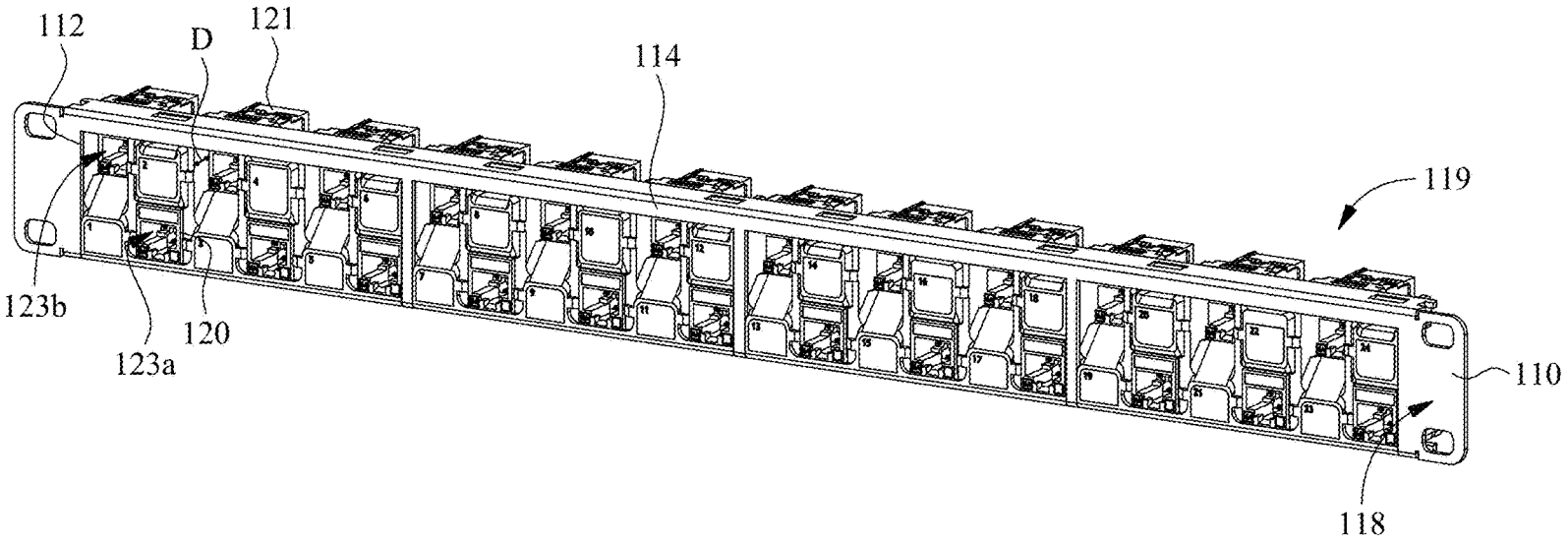
FIG. 5A is a perspective view of a patch panel from an angle of a plugging side of the patch panel according to an embodiment of the present invention.
Figure 5B:
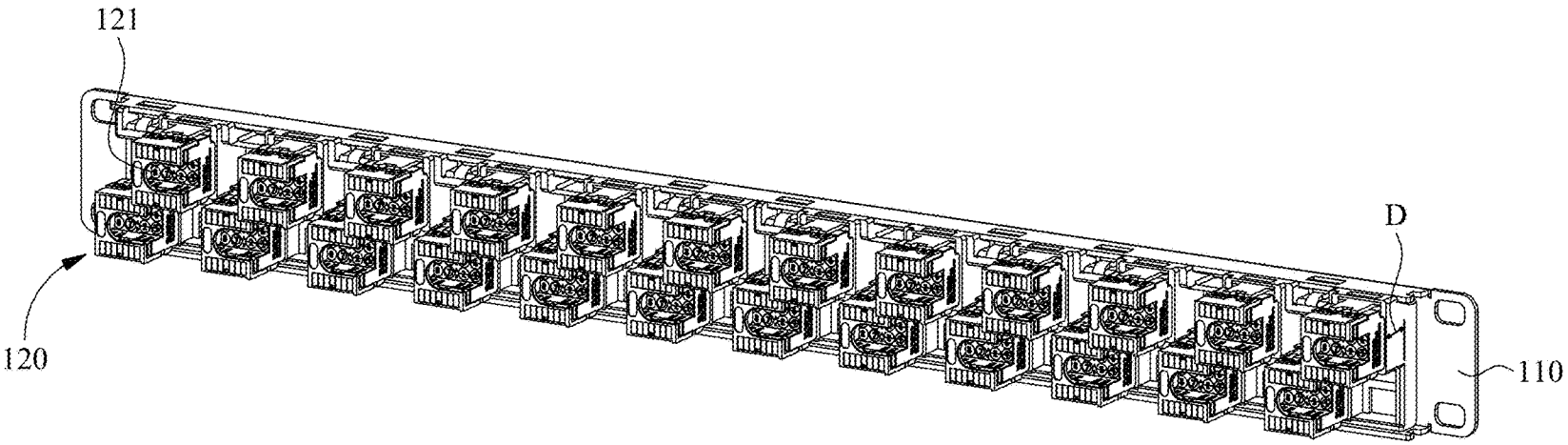
FIG. 5B is a perspective view of a patch panel from an angle of a terminal side of the patch panel shown in FIG. 5A.

The present invention is described below with reference to FIG. 5A and FIG. 5B. FIG. 5A is a perspective view of a patch panel from an angle of a plugging side of the patch panel according to an embodiment of the present invention. FIG. 5B is a perspective view of a patch panel from an angle of a terminal side of the patch panel shown in FIG. 5A. The patch panel comprises a plurality of sockets 120 and a mounting frame 110. The mounting frame 110 has a plugging side 118 and a terminal side 119. The plugging side 118 provides access to an external circuit with a connector disposed at one end thereof for plugging into the sockets 120 to effectuate electrical coupling and thus signal transmission. The terminal side 119 faces the inside of an equipment cabinet.

The mounting frame 110 has a mounting surface 114 on the plugging side 118. The sockets 120 are mounted on the mounting frame 110 such that the plugging planes of the sockets 120 are exposed from a plurality of vias 112 on the mounting surface 114 of the mounting frame 110. The plugging planes of the sockets 120 each define the profiles of the sockets 120. Referring to FIG. 5A, the planes surrounding the plugging recesses of the sockets 120 are parallel to the mounting surface 114. Referring to FIG. 5A, the sockets 120 are network sockets which comply with RJ-45 communication standard.

Referring to FIGS. 5A and 5B, in an embodiment of the present invention, the sockets 120 are disposed on the mounting frame 110 and arranged in two rows, including an upper row and a lower row. The plugging planes of the sockets 120 of one of the upper and lower rows retract from the mounting surface 114 toward the terminal side 119 by a predetermined distance D (so that the mounting surface 114 overlaps the plugging planes of non-retracted sockets); hence, the retracted plugging planes 123*b* of the retracted row do not lie on the same plane as the non-retracted plugging planes 123*a* of the non-retracted row. The retraction is achieved by a structure disposed on the mounting frame 110. Referring to FIG. 5B, the mounting frame 110 protrudes backward so that an affected point of the plugging side 118 sinks, thereby defining the required distance by which the plugging planes retract as soon as the sockets 120 are mounted on the mounting frame 110. Referring to FIG. 5A, a slope guides plugs into sockets 120 precisely and quickly. The predetermined distance D is the perpendicular distance between the mounting surface 114 and the retracted plugging planes 123*b*. The retracted plugging planes 123*b* give the predetermined distance D of retraction to the non-retracted plugging planes 123*a* located in the vicinity of the mounting surface 114 or overlapping the mounting surface 114 such that the retracted plugging planes 123*b* do not lie on the same plane as the non-retracted plugging planes 123*a*. This phenomenon is further illustrated with FIG. 7 and described later.

Figure 5C:
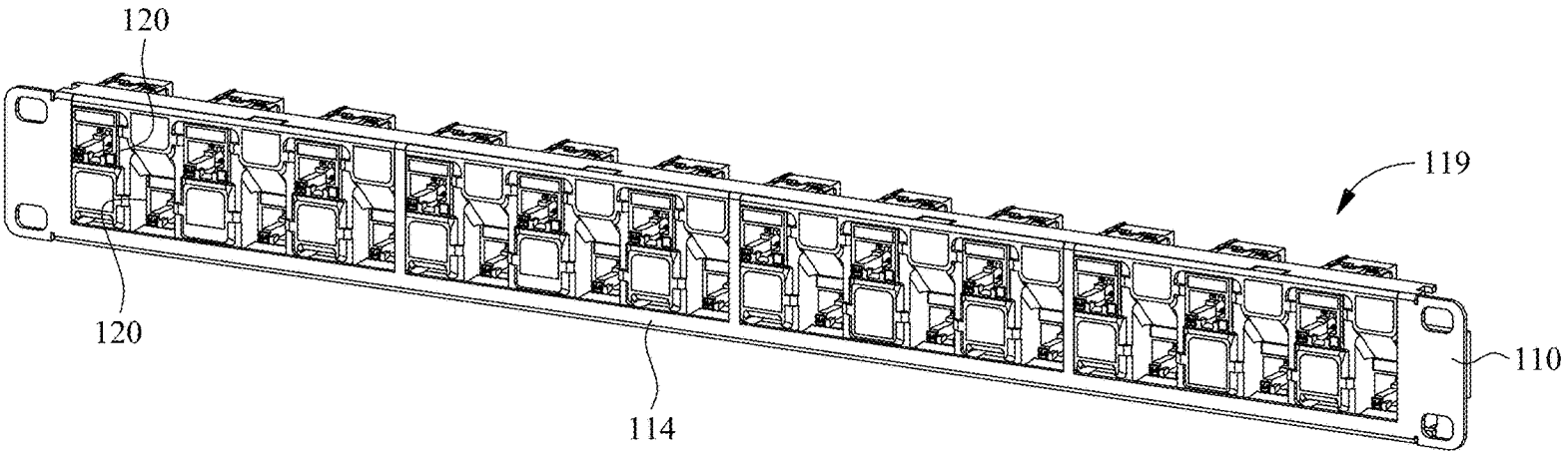
FIG. 5C is a perspective view of a patch panel according to an embodiment.

Referring to FIGS. 5A and 5B, the sockets of the upper row are neither aligned nor overlapped with the sockets of the lower row, wherein the sockets of the upper and lower rows comply with EIA-310 specification standard. Any two adjacent ones of the sockets of the same row are equidistant from each other. FIG. 5C shows a patch panel according to an embodiment, wherein the plugging planes of the sockets 120 of the lower row retract from the mounting surface 114 toward the terminal side 119 by a predetermined distance such that the plugging planes of the upper row do not lie on a same plane as the plugging planes of the lower row.

Figure 6:
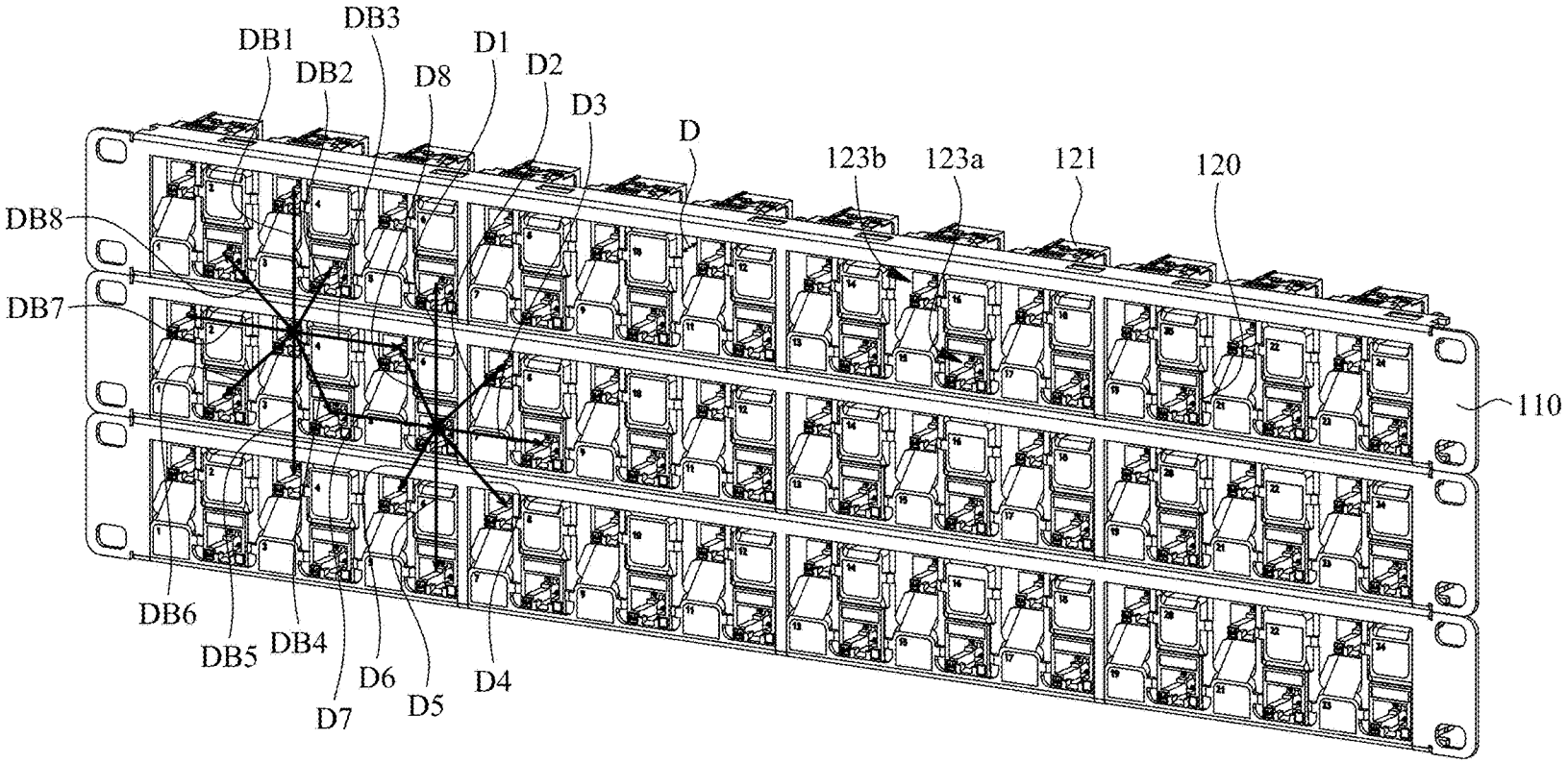
FIG. 6 is a perspective view of the stacked patch panels from an angle of the plugging side of the patch panels according to an embodiment of the present invention.
Figure 7:
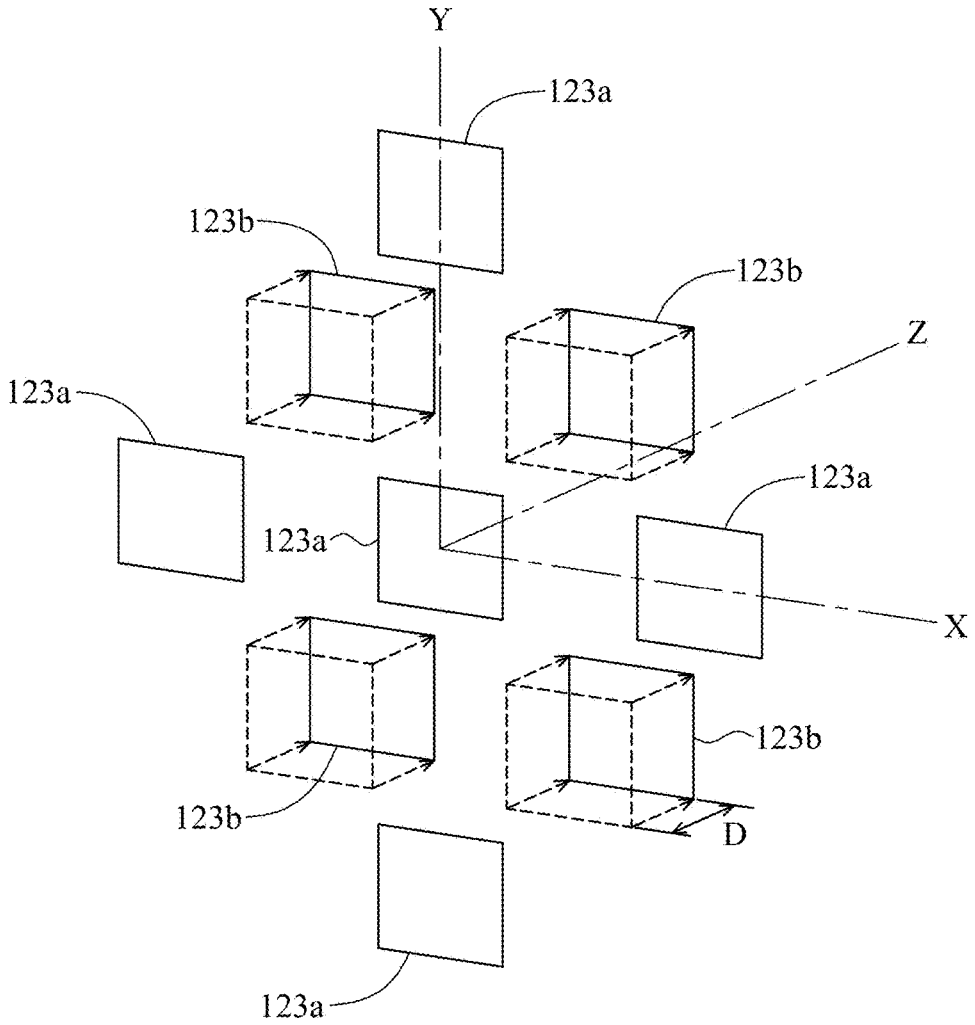
FIG. 7 is a schematic view of some sockets attributed to the patch panels of FIG. 6 and positioned relative to each other.

The present invention is further described below with reference to FIG. 6 and FIG. 7. FIG. 6 is a perspective view of the stacked patch panels from an angle of the plugging side of the patch panels according to an embodiment of the present invention. FIG. 7 is a schematic view of some sockets attributed to the patch panels of FIG. 6 and positioned relative to each other.

Referring to FIG. 6, the mounting frames 110 mounted on an equipment cabinet are tightly stacked one above the other, and in consequence alien crosstalk between the sockets give rise to the interference therebetween. FIG. 7 depicts the spatial difference in the sockets between the status of the retracted plugging planes and the status of the non-retracted plugging planes. In an embodiment of the present invention, not only do the sockets shift along Y-axis so that the sockets of the upper row do not align with the sockets of the lower row, but the sockets also shift along Z-axis, so as to offset alien crosstalk under a specific specification, such as TIA-568-C.2 and ISO-11801 ed.2, and in consequence the patch panels can be positioned at acceptable levels that support high speed, such as 10 Gbps or higher, such that no Ethernet needs to screen or shield the patch panels.

In an embodiment of the present invention, the shortest distances D2, D4, D6, D8, i.e., the first shortest distances, between the centers of the plugging planes of the sockets with non-retracted plugging planes and the centers of the plugging planes of the sockets with retracted plugging planes equal the shortest distances DB2, DB4, DB6, DB8, i.e., the second shortest distances, between the centers of the plugging planes of the sockets with retracted plugging planes and the centers of the plugging planes of the sockets with non-retracted plugging planes, that is, to say, the first shortest distances equal the second shortest distances. In another aspect, the shortest distances between the sockets and their respective adjacent sockets in the vertical direction are equal (for example, DB1=DB5=D1=D5), whereas the shortest distances between the sockets and their respective adjacent sockets in the horizontal direction are equal (for example, DB3=DB7=D3=D7). The predetermined distance equals 9~11 mm, preferably, 10 mm.

The sockets 120 mounted on the mounting frames 110 fall into one of the following two categories: (1) on the mounting frames 110, the plugging planes 123*b* of the sockets 120 of the upper row retract from the mounting surface toward the terminal side by a predetermined distance D such that the plugging planes 123*b* of the upper row lie on a plane different from the plugging planes 123*a* of the lower row; and (2) on the mounting frames 110, the plugging planes of the sockets 120 of the lower row retract from the plugging planes toward the terminal side by the predetermined distance such that the plugging planes of the lower row lie on a plane different from the plugging planes of the upper row. The aforesaid two categories are opposite and effective in suppressing noise according to the present invention. FIG. 6 illustrates mode (1).

Referring to FIG. 6, sockets with retracted plugging planes are subjected to the same interference as sockets with non-retracted plugging planes for the reason described below. The centers of the plugging planes of the sockets with retracted plugging planes are separated from the centers of the plugging planes of adjacent sockets above by distance DB1 and from the centers of the plugging planes of adjacent sockets below by distance DB5. The centers of the plugging planes of the sockets with non-retracted plugging planes are separated from the centers of the plugging planes of adjacent sockets above by distance D1 and from the centers of the plugging planes of adjacent sockets below by distance D5. The distances DB1, DB5 equal the distances D1, D5. The centers of the plugging planes of the sockets with retracted plugging planes are separated from the centers of the plugging planes of adjacent sockets on the left by distance DB7 and from the centers of the plugging planes of adjacent sockets on the right by distance DB3. The centers of the plugging planes of the sockets with non-retracted plugging planes are separated from the centers of the plugging planes of adjacent sockets on the left by distance D7 and from the centers of the plugging planes of adjacent sockets on the right by distance D3. The distances DB7, DB3 equal the distances D7, D3. The centers of the plugging planes of the sockets with retracted plugging planes are separated from the centers of the plugging planes of adjacent sockets on the upper right by distance DB2, from the centers of the plugging planes of adjacent sockets on the upper left by distance DB8, from the centers of the plugging planes of adjacent sockets on the lower right by distance DB4, and from the centers of the plugging planes of adjacent sockets on the lower left by distance DB6. The centers of the plugging planes of the sockets with non-retracted plugging planes are separated from the centers of the plugging planes of adjacent sockets on the upper right by distance D2, from the centers of the plugging planes of adjacent sockets on the upper left by distance D8, from the centers of the plugging planes of adjacent sockets on the lower right by distance D4, and from the centers of the plugging planes of adjacent sockets on the lower left by distance D6. The distances DB2, DB4, DB6, DB8 equal the distances D2, D4, D6, D8. Due to the aforesaid distances, the sockets are equal in alien crosstalk.

Figure 8:
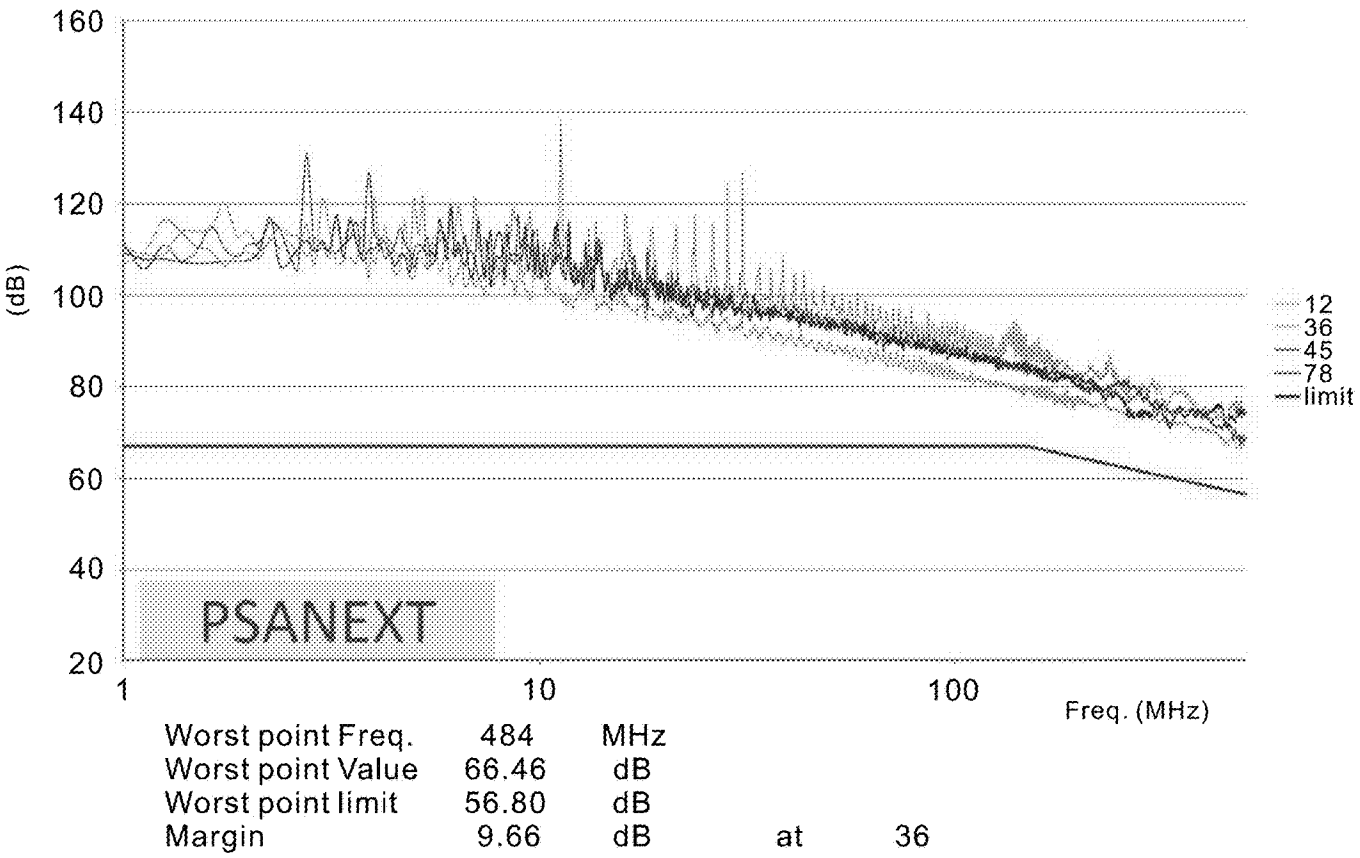
FIG. 8 is a graph of measurement of alien crosstalk of the patch panels of FIG. 6.

The present invention is further described below with reference to FIG. 8. Referring to FIG. 8, there is shown a graph of measurement of alien crosstalk of the patch panels of FIG. 6. By increasing the distance between adjacent sockets along Y-axis and Z-axis (see FIG. 7), alien crosstalk that occurs to the sockets in the course of signal transmission is kept below a specified standard level. Hence, in the embodiments of the present invention, a patch panel is effective in offsetting alien crosstalk without violating the EIA-310 standard.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. A patch panel, comprising a plurality of sockets and a mounting frame, the mounting frame having a plugging side and a terminal side, having a mounting surface on the plugging side, and being mounted with the sockets such that plugging planes of the sockets are exposed from a plurality of vias on the mounting surface of the mounting frame, characterized in that:

the sockets are disposed on the mounting frame and arranged in two parallel rows including an upper row and a lower row, wherein the plugging planes of the sockets of one of the upper and lower rows retract from the mounting surface toward the terminal side by a predetermined distance such that the plugging planes of the retracted row do not lie on a same plane as the plugging planes of the non-retracted row.

2. The patch panel of claim 1, wherein the sockets of the upper row are neither aligned nor overlapped with the sockets of the lower row.

3. The patch panel of claim 2, wherein any two adjacent ones of the sockets of the same row are equidistant from each other.

4. The patch panel of claim 1, wherein shortest distances between centers of the plugging planes of sockets with non-retracted plugging planes and centers of the plugging planes of adjacent sockets with retracted plugging planes are equal and defined as the first shortest distances, whereas shortest distances between centers of the plugging planes of sockets with retracted plugging planes and centers of the plugging planes of adjacent sockets with non-retracted plugging planes are equal and defined as the second shortest distances, with the first shortest distances being equal to the second shortest distances.

5. The patch panel of claim 4, wherein shortest distances between the sockets and their respective adjacent sockets in a vertical direction are equal, whereas shortest distances between the sockets and their respective adjacent sockets in a horizontal direction are equal.

6. The patch panel of claim 5, wherein the predetermined distance is 10 mm, with the sockets being network sockets which comply with RJ-45 communication standard, wherein configuration between the mounting frame and each said socket complies with EIA-310 specification standard.

7. A patch panel structure, comprising a plurality of sockets and a plurality of mounting frames mounted on an equipment chassis, with the mounting frames being tightly stacked vertically, each having a plugging side and a terminal side, each having a mounting surface on the plugging side, and each being mounted with the sockets such that plugging planes of the sockets are exposed from a plurality of vias on the mounting surfaces of the mounting frames, characterized in that:

the sockets are disposed on each said mounting frame and arranged in two parallel rows, including an upper row and a lower row, in one of two ways below:

on each mounting frame, the plugging planes of the sockets of the upper row retract from the mounting surface toward the terminal side by a predetermined distance such that the plugging planes of the upper row do not lie on a same plane as the plugging planes of the lower row; and on each mounting frame, the plugging planes of the sockets of the lower row retract from the mounting surface toward the terminal side by a predetermined distance such that the plugging planes of the upper row do not lie on a same plane as the plugging planes of the lower row.

8. The patch panel structure of claim 7, wherein shortest distances between the centers of the plugging planes of the sockets with non-retracted plugging planes and the centers of the plugging planes of the adjacent sockets with retracted plugging planes are equal and defined as the first shortest distances, whereas shortest distances between centers of the plugging planes of sockets with retracted plugging planes and centers of the plugging planes of adjacent sockets with non-retracted plugging planes are equal and defined as the second shortest distances, with the first shortest distances being equal to the second shortest distance;

shortest distances between the sockets and their respective adjacent sockets in a vertical direction are equal, whereas shortest distances between the sockets and their respective adjacent sockets in a horizontal direction are equal; and shortest distances between the sockets and their respective adjacent sockets in a vertical direction are equal, whereas shortest distances between the sockets and their respective adjacent sockets in a horizontal direction are equal, wherein the centers of the plugging planes of the sockets with retracted plugging planes and the centers of the plugging planes of the sockets with non-retracted plugging planes are equidistant from the centers of the plugging planes of adjacent sockets on the upper right, from the centers of the plugging planes of adjacent sockets on the upper left, from the centers of the plugging planes of adjacent sockets on the lower right, and from the centers of the plugging planes of adjacent sockets on the lower left such that sockets with retracted plugging planes are subjected to the same interference as sockets with non-retracted plugging planes, respectively.

9. The patch panel structure of claim 8, wherein the predetermined distance is 10 mm, with the sockets being network sockets which comply with RJ-45 communication standard, wherein configuration between the mounting frames and each said socket complies with EIA-310 specification standard.

* * * * *